US007633447B2

(12) United States Patent
Teshima et al.

(10) Patent No.: US 7,633,447 B2
(45) Date of Patent: Dec. 15, 2009

(54) ANTENNA DEVICE TO BE LOADED INTO AN INFORMATION PROCESSING APPARATUS

(75) Inventors: Masao Teshima, Kunitachi (JP); Hiroshi Shimasaki, Hamura (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 342 days.

(21) Appl. No.: 11/786,580

(22) Filed: Apr. 12, 2007

(65) Prior Publication Data

US 2008/0036682 A1 Feb. 14, 2008

(30) Foreign Application Priority Data

May 26, 2006 (JP) ..... 2006-146623

(51) Int. Cl.
*H01Q 1/24* (2006.01)

(52) U.S. Cl. ..... 343/702; 455/557

(58) Field of Classification Search ..... 343/702, 343/700 MS, 846; 455/556.1, 557
See application file for complete search history.

(56) References Cited

U.S. PATENT DOCUMENTS 6,646,607 B2 * 11/2003 Usui et al. ..... 343/700 MS
6,972,722 B2 12/2005 Katoh et al.
7,148,849 B2 * 12/2006 Lin ..... 343/700 MS
7,271,769 B2 * 9/2007 Asano et al. ..... 343/702
7,439,911 B2 * 10/2008 Wang ..... 343/700 MS
2004/0209646 A1 10/2004 Murayama et al.

FOREIGN PATENT DOCUMENTS

JP 2005-102286 4/2005

* cited by examiner

*Primary Examiner*—Tho G Phan
(74) *Attorney, Agent, or Firm*—Blakely, Sokoloff, Taylor & Zafman LLP

(57) ABSTRACT

An antenna device to be loaded into an information apparatus has an antenna unit composed of antenna members which have a plurality of radio communication frequency bands, and which are divided into two of an element part having a flexural portion and a GND part, and a holding member composed of a member having non-conductivity, such as a resin member, to hold the respective antenna members so as to leave a constant gap g from the antenna members within a window area, the holding member being mounted so as to hang on an edge at the outside of a frame body of a liquid crystal display panel in an LCD housing of a PC.

17 Claims, 4 Drawing Sheets

ANTENNA DEVICE TO BE LOADED INTO AN INFORMATION PROCESSING APPARATUS

CROSS-REFERENCE TO RELATED APPLICATIONS

This application is based upon and claims the benefit of priority from Japanese Patent Application No. 2006-146623, filed May 26, 2006, the entire contents of which are incorporated herein by reference.

BACKGROUND

1. Field

One embodiment of the present invention relates to an antenna device which is loaded into an information processing apparatus such as a portable personal computer, to carry out radio communication.

2. Description of the Related Art

In general, communications of various information are carried out by connecting a portable personal computer (hereinafter called PC) to other PCs, peripheral devices, or communication devices. When a PC is made to function as one terminal with respect to a communication network such as a local area network (LAN), the PC has been wire-connected by a LAN cable. However, radio communication using radio has become mainstream because of inconvenience in mobility and connection.

Therefore, PCs with a card and the like, having a radio communication system function such as an antenna, inserted into an external connecting terminal (slot) have been used. However, among portable PCs, built-in radio communication systems have been desired. For portable PCs, reduction in size and weight has been strongly encouraged as well as high durability against damage caused by impact (e.g., dropping or the like).

When the PC has a configuration in which a keyboard side main housing and a liquid crystal display panel side housing are connected rotatably with one or a plurality of hinges, a module for carrying out communication processing or the like in the radio communication system is arranged in the vicinity of the keyboard, and an antenna unit is arranged in the liquid crystal display panel (LCD) side housing, and is connected by a cable passing through the hinges.

As a miniaturized antenna, in Japanese Patent Application (KOKAI) No. 2006-33069, for example, there is disclosed a flat antenna which does not require a matching circuit, and capable of extending bandwidth over a total region from a low-pass side resonant frequency up to a high-pass side resonant frequency.

DETAILED DESCRIPTION

Various embodiments according to the invention will be described hereinafter with reference to the accompanying drawings. In general, according to one embodiment of the invention, an antenna device to be loaded into an information processing apparatus includes an antenna unit composed of antenna members which support a plurality of radio communication frequency bands, and which are formed by dividing into two; and a holding member which holds each of the antenna members leaving a constant gap therebetween from a front face side. In the antenna device, the holding member holds the antenna members so as to cover a flexural portion of one of the antenna members and has a window area which exposes a region at which the gap is formed and respective power feeding regions to which a communication cable for propagating signals received and transmitted are connected.

Hereinafter, embodiments of the present invention will be described in detail with reference to the drawings.

Figure 1B:
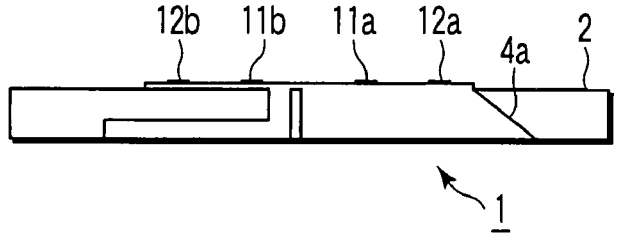
FIGS. 1A, 1B, 1C and 1D are views each showing an overall external configuration of an antenna device to be loaded into an information processing apparatus according to a first embodiment.
Figure 1C:
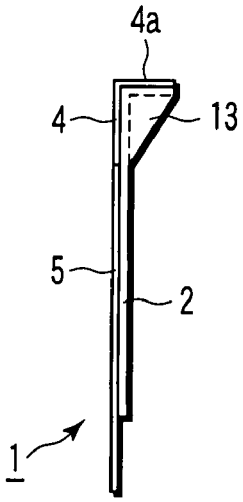
Figure 1A:
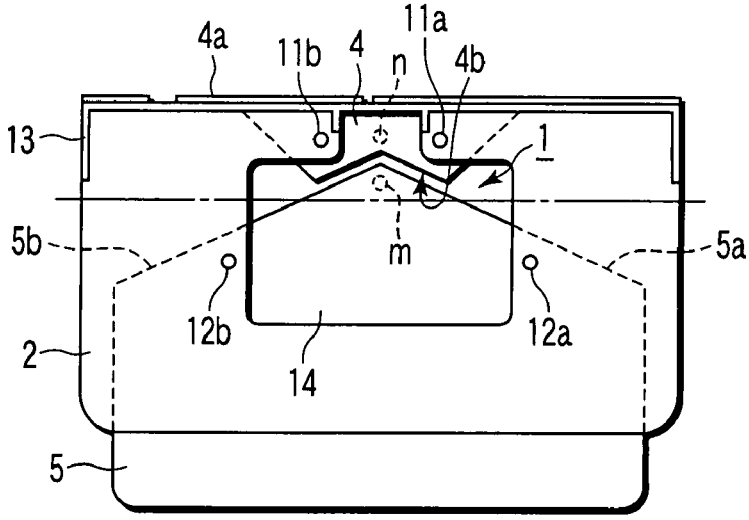
Figure 1D:
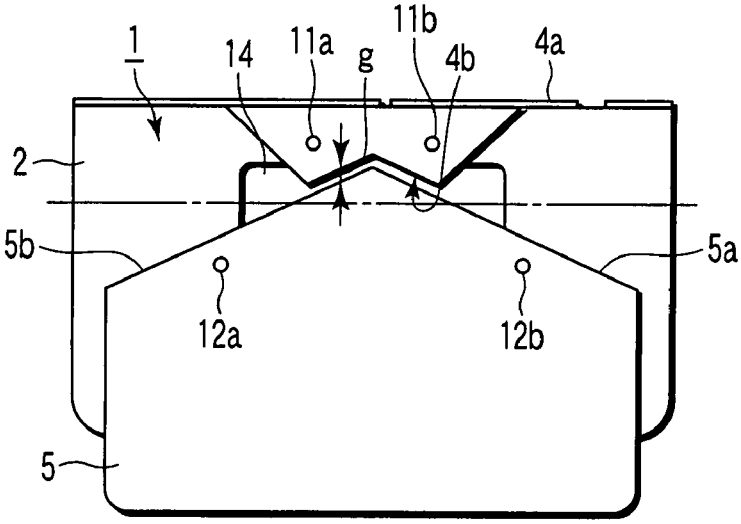

FIGS. 1A, 1B, 1C and 1D each shows an overall external configuration of an antenna device to be loaded into an information processing apparatus according to a first embodiment of the invention. FIG. 1A is a view showing a front configuration (front face side) of the antenna device, FIG. 1B is a view showing a top configuration of the antenna device, FIG. 1C is a view showing a side configuration of the antenna device, and FIG. 1D is a view showing a back configuration (rear face side) of the antenna device.

The antenna device is mounted in a liquid crystal display panel side housing (LCD side housing) of an information processing apparatus, for example, a portable personal computer (PC), so-called a notebook personal computer. Further, a communication module (not shown) connected to the antenna device is provided in a keyboard side main housing of the PC.

The antenna device, for example, is configured with an antenna unit 1 composed of two antenna portions using plates of metal or conducting material, and a holding member 2 for holding antenna unit 1 in the LCD side housing so as to leave a predetermined arranging interval (gap g) between the antenna portions, for example. Note that gap g is a distance by which designed antenna characteristics are realized, and the value of the gap g is calculated every time of designing an antenna device.

The antenna unit 1 in the present embodiment is configured with two portions, for example, an element part 4 and a ground (GND) part 5. Connected to the element part 4 and the GND part 5, a communication cable 6 (shown in FIGS. 3A, 4A and 5A, for example), which will be described later, is composed of a coaxial cable for propagating a communication signal between transmitting and receiving modules (not shown).

A size and a shape of the element part 4 are designed so as to carry out transmission and reception within frequency bands of, for example, a UWB band (3.1 to 4.8 GHz) and a Bluetooth® band (2.4 to 2.5 GHz). According to one embodiment of the invention, the GND part 5 forms a pentagon (home plate shape) extending one side of a rectangular shape into a triangular shape with oblique lines 5*a* and 5*b* which are two sides crossing one another. Note that an angle between the oblique lines 5*a* and 5*b* is appropriately set in design.

The element part 4 forms a trapezoidal shape, for example, in which, the respective both ends of the bottom side (wide side) and the top side (narrow side) are connected with other two sides. In this example, the narrow side of the element part 4 is arranged so as to face the oblique lines 5*a* and 5*b* of the triangular shape of the GND part 5 with a gap g therebetween. Gap g is a constant interval. For this reason, the narrow side of the element part 4 is formed in a notched shape 4*b* notched in the similar shape as that of the oblique lines 5*a* and 5*b*.

Accordingly, when the element part 4 and the GND part 5 are arranged, those are arranged such that the notched shaped narrow side of the element part 4 and the extended top of the GND part 5 formed by the oblique lines 5*a* and 5*b* are made to face each other with a constant gap g.

Further, connecting regions (power feeding parts m and n) for connecting to the communication cable 6 by soldering or the like are provided in the vicinity of the concave-convex portions of the pointed extremity at the respective front face sides of the element part 4 and the GND part 5.

Moreover, a top part 4*a* of the element part 4 has a flexural portion, which is inflected so as to stand up to the front face side. In this example, it is assumed that the top part 4*a* is generally inflected at a right angle. However, it is not limited to a right angle.

The holding member 2 is composed of a member having non-conductivity, for example, a resin member. The holding member 2 is formed in an L-shape so as to fix the element part 4 and the GND part 5 including the flexural portion of the top part 4*a* from the front face side (the inside with respect to the PC housing) while leaving an arranging interval (gap g) between the element part 4 and the GND part 5 described above.

At each of the element part 4 and the GND part 5, at least two apertures respectively are opened. At the rear face side of the holding member 2, convex fixing parts 11*a*, 11*b*, 12*a* and 12*b* which are fitted into these apertures, and with which positioning of the element part 4 and the GND part 5 can be carried out are provided. The respective apertures of the element part 4 and the GND part 5 are fitted to these fixing parts 11*a*, 11*b*, 12*a* and 12*b*, and the element part 4 and the GND part 5 are fixed by thermally welding the fixing parts 11*a*, 11*b*, 12*a* and 12*b* so as to be embedded into the respective apertures from the top surface to be coagulated in rivet forms. It goes without saying that it suffices to fix those by resin molding after the element part 4 and the GND part 5 are arranged in a resin mold, at the time of forming the holding member 2.

Provided that distances between these fixing parts 11*a* and 11*b*, 12*a* and 12*b* are designed to be as short as possible, a divergence between the element and the GND is made less (a distance floating from the resin material is made short) at the time of inflecting the resin material, which can prevent disconnection of the cable at the feeding parts.

It can be realized by, as another method of fixation, fixing with a plurality of claw portions are formed on a resin member by sandwiching the element part 4 and the GND part 5, or using a method such as gluing, screwing, or metal riveting. Provided that the antenna characteristics are not changed at least, various methods of fixation can be used. However, a method by which a thickness is not increased is preferable.

Reinforcing parts (rib) 13 connected to the element part 4 and its top part 4*a* in a direction perpendicular thereto as shown in FIG. 1C are provided to the holding member 2 in order to prevent a deformation due to distortion or the like in the holding member, and to reinforce the strength of the flexural portion with the element part 4 and its top part 4*a*. In the present embodiment, the ribs 13 are formed in an integrated manner at the time of resin molding by using a same resin material with the holding member 2 at the both ends (L cross-sectional portions). Note that material of the ribs are not limited to the resin material, but any material suffices provided that it is possible to reinforce without any effect on the antenna characteristics, and it may be not necessarily formed in an integrated manner, but attached later. Note that the ribs 13 are provided in shapes and at positions so as not to overlap with other components, for example, the LCD frame body in the thickness direction when ribs 13 are mounted in the LCD side housing, which contributes to the flat design of the LCD panel side housing.

Further, at the holding member 2, a window area 14 is opened. The window area exposes connecting regions (power feeding parts m and n) of the communication cable 6 which will be described later and a gap g in the element part 4 and the GND part 5, so as not to overlap the holding member. The window area 14 is provided in order to, first, prevent a distortion in the holding member 2 by heat at the time of soldering the communication cable to the element part 4 and the GND part 5. Second, the window area 14 is provided in order to reduce the effect on a resonant frequency by a dielectric constant of the holding member 2 by distancing the holding member 2 from the power feeding parts m and n, and a gap g onto which high-frequency current is concentrated at the time of communication.

Because the antenna device structured in this way is compact, the antenna device can be mounted at any position in the LCD side housing. However, in practice, a plurality of antenna devices may be mounted in one LCD side housing, it should be considered that the antenna characteristics are not deteriorated when interference is brought among the antenna devices. Usually, because most of the cubic capacity in a housing 21 is occupied with a liquid crystal display panel 22, a degree of freedom in a mounting position is low. Further, because a communication signal is attenuated by lead-around (a distance) of the communication cable, it is preferred to connect to a communication module at a short distance.

Figure 2B:
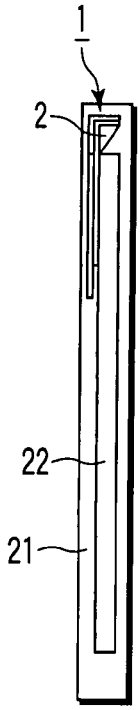
FIGS. 2A and 2B are views for explanation of mounting of an LCD side housing of the antenna device.
Figure 2A:
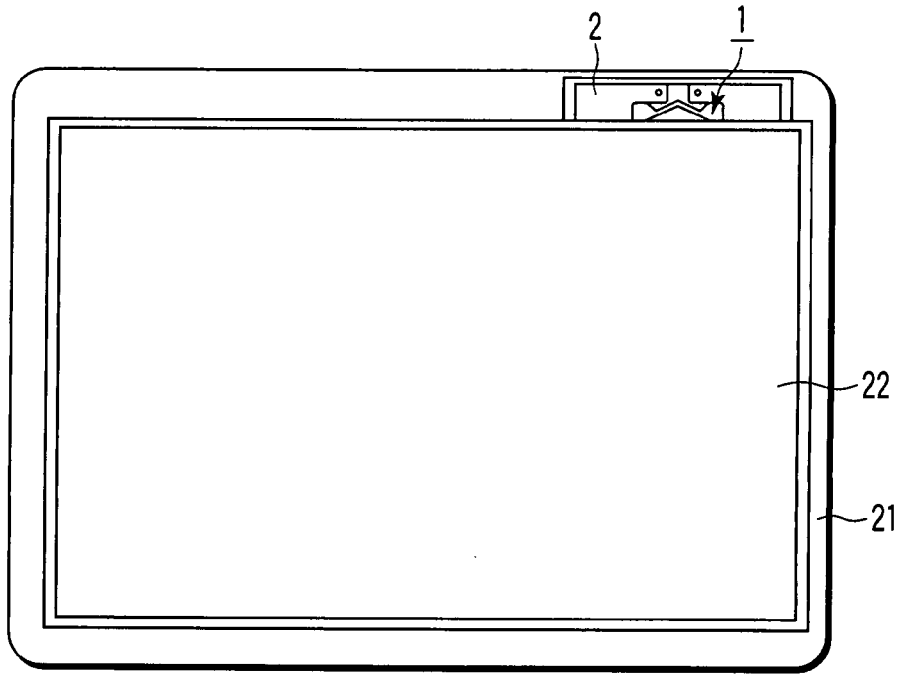

In one embodiment of the invention, as shown in FIGS. 2A and 2B, the antenna device is fixedly mounted such that the flexural top part 4*a* of the element part 4 is generally placed along the inner wall of the edge at the peripheral portion of the LCD side housing 21. In this layout example, it is assumed that a configuration is made such that the antenna device is connected to the keyboard side main housing by hinges (not shown) at the lower portion. In a state in which the LCD side housing 21 is opened when the PC is used, the antenna device is placed at a highest position, and satisfactory radio communication can be expected.

On the other hand, when the element portion of the antenna device overlaps in the thickness direction with the metal frame body of the liquid crystal display panel 22, a wireless signal may be blocked and, on occasion cannot be transmitted and received sufficiently. Then, in the present embodiment, the gap sides of the element part 4 and the GND part 5 which are more ahead of a position shown by a dashed line in FIGS. 1A and 1D are arranged so as to protrude toward the circumferential side from the metal frame body of the liquid crystal display panel 22.

In this way, because the gap sides of the element part 4 and the GND part 5 protrude toward the circumferential side from the metal frame body of the liquid crystal display panel 22, satisfactory communication can be carried out without any effect on radio communication.

Figure 3B:
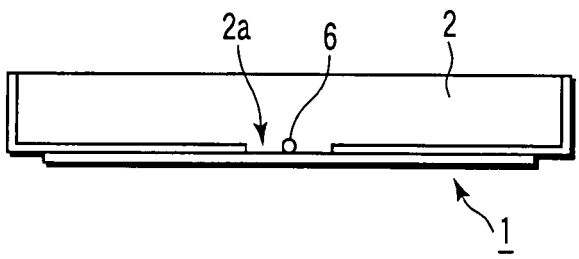
FIGS. 3A and 3B are views showing a first configuration example of lead-around of a cable.
Figure 3A:
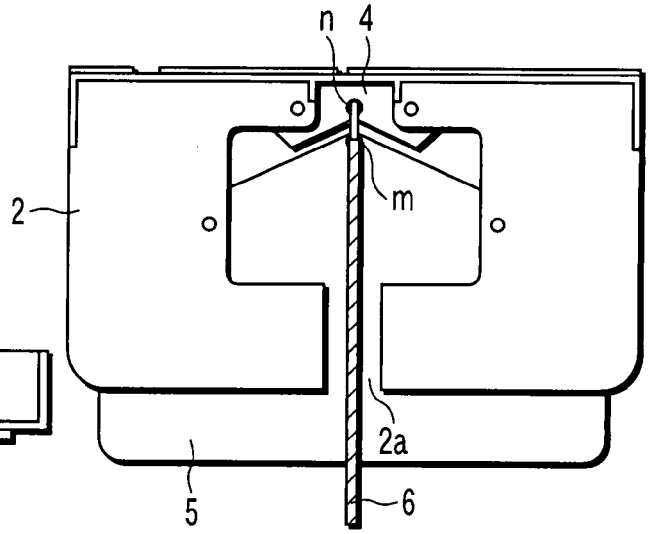

In FIGS. 3A and 3B, a first configuration example with respect to lead-around of the communication cable 6 which is composed of a coaxial cable connected to the power feeding parts m and n which are provided to the element part 4 and the GND part 5 to be connecting areas of the cable is shown.

In this first configuration example, the coaxial cable core wire is soldering-connected to the power feeding part n of the element part 4 shown in FIG. 1A, and the coaxial cable grounding wire is soldering-connected to the power feeding part m of the GND part 5 shown in FIG. 1A. Note that a connection method is not limited to soldering, and a brazing technique or a spot-welding technique can be used.

In this configuration example, the communication cable 6 is led out in the arranging direction of the element part and the GND part 5 (downward direction on the page). Moreover, a portion of the holding member 2 which overlaps with the communication cable 6 is eliminated so as to be notched.

The holding member 2 is thinner than a diameter of the communication cable 6, and is provided at an inner side (antenna front face side) from the antenna unit 1 as seen from the PC housing. As a result, a configuration is made such that a notched portion is formed at the holding member 2, and the communication cable 6 is wired on the notched portion. As a consequence, a thickness (height) of the antenna device including the holding member is made to be a length that a diameter of the communication cable 6 is added to a thickness of the GND part 5, and the flat design can be further achieved as compared with a housing in which the holding member 2 is arranged at the outside of the antenna unit 1. Note that, in the case where the holding member 2 is arranged at the outside of the antenna unit 1, the thickness of the antenna device is a total of a thickness of the holding member 2, a thickness of the GND part 5, and a diameter of the communication cable 6.

Due to this flat design, an interval between the liquid crystal display panel 22 and the metal frame body can be made narrower. Accordingly, the flat design of the LCD side housing in which the antenna device has been mounted can be achieved.

Figure 4B:
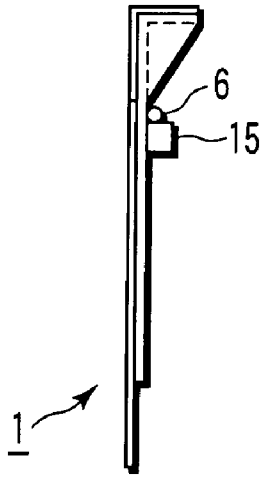
FIGS. 4A and 4B are views showing a second configuration example of lead-around of a cable.
Figure 4A:
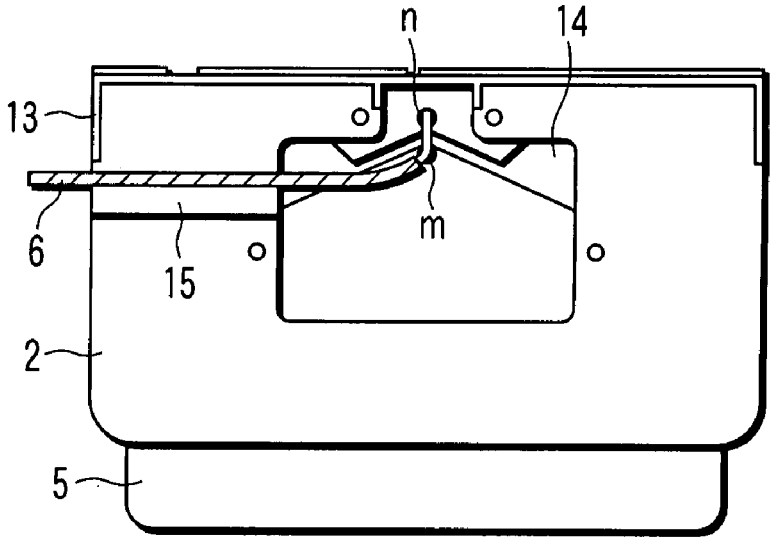

In FIGS. 4A and 4B, a second configuration example with respect to lead-around of the communication cable 6 which is composed of a coaxial cable soldering-connected to the power feeding parts m and n of the element part 4 and the GND part 5 is shown. In this second configuration example, in the same way as in the first configuration example described above, the communication cable 6 is soldering-connected to the power feeding parts m and n of the element part 4 and the GND part 5.

In this configuration example, the communication cable 6 is led out in a direction parallel to the flexural direction of the top part 4*a* of the element part 4. A cable guide 15 is provided along the communication cable 6 on the holding member 2 in order for the led-out communication cable 6 not to be moved.

Accordingly, by leading out the communication cable 6 along the cable guide 15 in such a configuration, movement of the communication cable 6 is limited, which reduces a load onto the areas soldering-connected by the movement of the cable, and then it is possible to prevent damages such as peeling. Further, it is possible to reduce changes in the antenna characteristics due to the movement of lead-around of the communication cable 6, and variations in the characteristics among the antenna devices at the time of manufacturing.

In the second configuration example, the example in which the holding member 2 is arranged at the inside (at the front face side having the flexural portion) of the antenna unit 1 has been described. However, the holding member 2 may be provided at the outside of the antenna unit 1. Namely, the holding member 2 is formed so as to cover the flexural portion of the element part 4 from the outside, and so as to elongate from the window area in parallel with the arranging direction of the element part 4 and the GND part 5. The guide member is formed so as not to overlap with the element part 4 and the GND part 5, and the communication cable 6 is wired along the guide member.

Figure 5B:
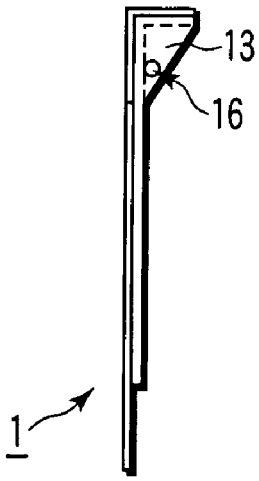
FIGS. 5A and 5B are views showing a third configuration example of lead-around of a cable.
Figure 5A:
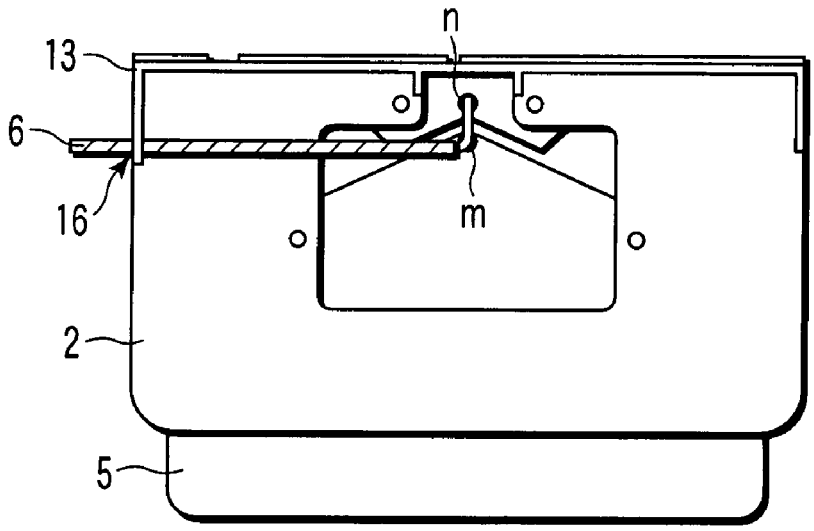

In FIGS. 5A and 5B, a third configuration example with respect to lead-around of the communication cable 6 which is composed of a coaxial cable soldering-connected to the power feeding parts m and n of the element part 4 and the GND part 5 is shown. In this third configuration example, the communication cable 6 is soldering-connected to the power feeding parts m and n of the element part 4 and the GND part 5 in the same way as in the first configuration example described above.

In this configuration example, the communication cable 6 is led out in a direction parallel to the flexural direction of the top part 4*a* of the element part 4. A cable supporting aperture 16 is opened at the rib 13, and the communication cable 6 penetrates to be installed on the holding member 2 in order for the led-out communication cable 6 not to be moved.

The communication cable 6 is led out so as to penetrate to be installed through the cable supporting aperture 16 which is provided at the rib 13 by such a configuration. Consequently, movement of the communication cable 6 is limited, which reduces a load onto the areas soldering-connected by the movement of the cable, and then it is possible to prevent damages such as peeling or the like. Further, it is possible to reduce changes in the antenna characteristics due to the movement of lead-around of the communication cable 6, and variations in the characteristics among the antenna devices at the time of manufacturing.

Figure 6B:
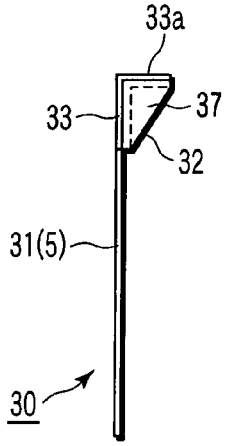
FIGS. 6A and 6B are views each showing an overall external configuration of an antenna device according to a second embodiment.
Figure 6A:
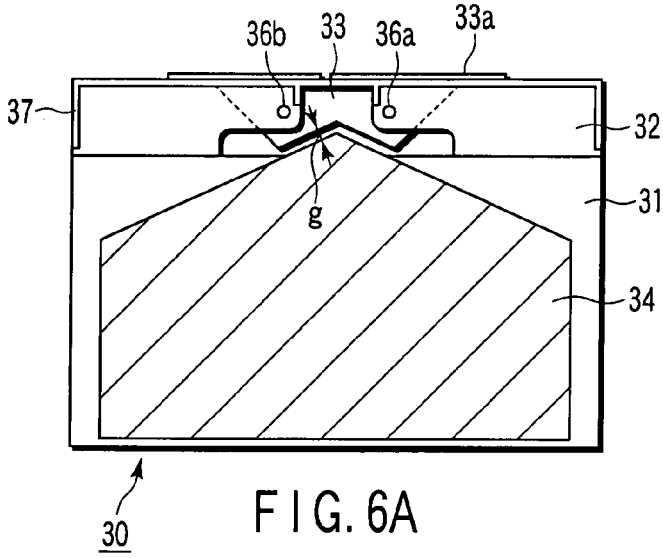

FIGS. 6A and 6B each shows an overall external configuration of the antenna device according to a second embodiment of the invention. FIG. 6A is a view showing a front configuration (front face side) of the antenna device, and FIG. 6B is a view showing a side configuration of the antenna device. Note that, among the components in the present embodiment, the same components as those of the first embodiment described above are denoted by the same reference numerals, and detailed descriptions thereof will not be repeated.

The antenna device in the illustrated embodiment is mounted in a portable personal computer (PC) in the same way as in the first embodiment described above, and a configuration of a holding member is different therefrom. Further, an antenna device is provided in a communication module (not shown) in the keyboard side main housing of the PC also in the same way.

This antenna device is, as shown in FIG. 6A, configured with an antenna unit 30 formed on a flexible substrate 31, and a holding member 32 for holding the flexible substrate 31 and the antenna unit 30 in whole to be fixed into the LCD housing. A polyimide sheet may be used as the flexible substrate 31 for example.

The antenna unit 30 forms an element part 33 and a ground (GND) part 34 which are composed of copper sheets in the same shapes as those in the first embodiment, on the flexible substrate 31, and has a cable for propagating a communication signal to a transmitting and receiving module (not shown). The antenna device is formed by using a general semiconductor manufacturing technique (a photolithography technique, a deposition technique, an etching technique, or the like).

Further, at the flexible substrate 31, a window area 35, which exposes connecting regions (power feeding parts) of the communication cable in the antenna unit 30, and a gap g so as not to overlap, is opened. This window area 35 is, in the same way as in the first embodiment, provided in order to prevent a thermal distortion in the holding member 32 at the time of soldering-connection, and to reduce the effect on a resonant frequency by a dielectric constant of the holding member 32 due to high-frequency current being concentrated.

Moreover, as shown in FIG. 6B, a top part 33*a* of the element part 33 is inflected so as to stand up at the front face side.

The holding member 32 is composed of a member having non-conductivity, for example, a resin member, and is formed in an L-shape at which ribs 37 having the similar function as that of the reinforcing ribs 13 described above are provided. The holding member 32 is fixed to portions overlapping with the element part 33 and the top part 33*a*, which are positioned on the flexible substrate 31. In the fixing, at least two apertures are opened at a part of the flexible substrate 31 with which the element part 33 overlaps. Fixing parts 36*a* and 36*b* fitted into these apertures are provided on the rear face side of the holding member 32. With the fixing parts 36*a* and 36*b*, positioning of the antenna unit 30 (the element part 33 and the GND part 34) can be carried out.

The respective apertures of the antenna unit 30 are fitted to these fixing parts 36*a* and 36*b*, and the holding member 32 is fixed to the flexible substrate 31 by thermally welding the fixing parts 36*a* and 36*b* so as to be embedded into the respective apertures from the top surface to be coagulated in rivet forms. It is contemplated that this can be achieved by using another method of fixation in the same way as in the first embodiment.

In accordance with one embodiment of the invention, the same effect as that in the first embodiment can be obtained. Further, by fixing the flexural portion of the element part by the holding unit, an angle of inflection can be made constant among the antenna devices, which can suppress variations in the antenna characteristics.

In this embodiment, the example in which the element part and the GND part of copper thin films are formed on the flexible substrate has been described. However, as a modified example using the first and second embodiments, an antenna device may be configured with laminating an element part and a GND part which are composed of steel plates with a polyimide thin film sheet which is the same as the material of the flexible substrate.

Next, a configuration in which an antenna device is mounted in an LCD side housing will be described.

Figure 7A:
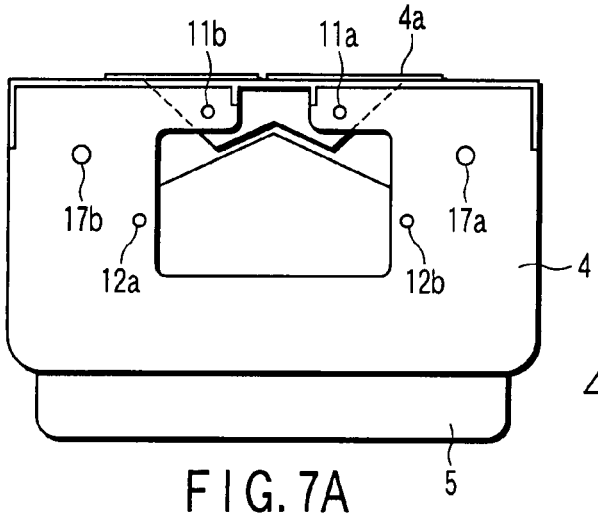
FIGS. 7A and 7B are views for explanation of a first mounting structure in which the antenna device according to the first embodiment is mounted in the LCD side housing.
Figure 7B:
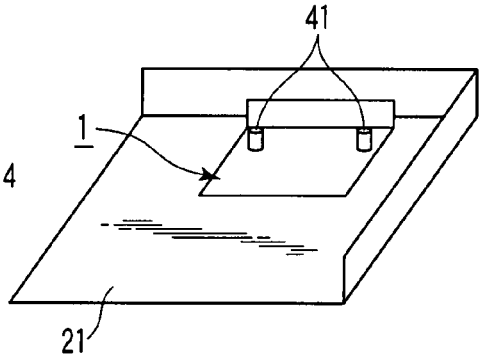

FIGS. 7A and 7B are views for explanation of a first mounting structure in which the antenna device is mounted in the LCD side housing in the first embodiment.

As shown in FIG. 7A, at least two mounting apertures 17*a* and 17*b* are opened at positions which do not penetrate the element part and the GND part of the holding member 2 of the antenna device. Further, as shown in FIG. 7B, convex parts for mounting 41 which are fitted into the mounting apertures 17*a* and 17*b*, and which define a mounting position of the antenna device are formed at the inner surface of the LCD side housing 21. When the LCD side housing is manufactured of a resin, these convex parts for mounting 41 are formed at the same time of molding the housing.

By merely fitting the mounting apertures 17*a* and 17*b* to the convex parts for mounting 41 of the housing, the antenna device can be mounted into a position determined in advance, which improve efficiency of the operation. Moreover, because the convex parts for mounting 41 are at the same positions among the respective devices, there is no difference in the mounting positions in accordance with a mounting operation, which makes it possible to suppress variations in the antenna characteristics.

Further, when a plurality of antenna devices such as antenna devices having different frequency bands or diversity antenna devices are mounted in an LCD side housing, the opening positions of the mounting apertures 17*a* and 17*b*, and the convex parts for mounting 41 are formed so as to be defined for each antenna device. By changing opening positions, an operation mistake in which an operator mounts a device at a wrong position can be eliminated. Note that, in place of changing mounting aperture positions, by combining different shapes, for example, a circle and a triangle, as shapes of the mounting apertures, the same effect can be obtained.

Further, when the antenna device is fixedly mounted, after the antenna device is mounted, the convex parts for mounting 41 are coagulated in rivet forms by being pressed while adding heat thereto, which can fix the antenna device. Further, if repairing and exchanging are taken into consideration, it may be configured such that the antenna device is covered with caps or the like which are separately prepared onto the convex parts for mounting 41, or by using E rings, etc. Further, it may be configured such that a member for holding antenna device is provided at the frame body of the liquid crystal display panel 22, which makes it possible to execute to fixedly mount the antenna device at the same time of fixing the liquid crystal panel.

Figure 8A:
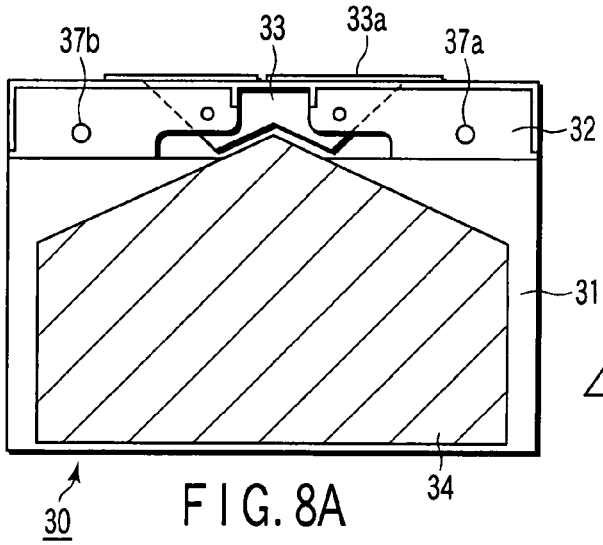
FIGS. 8A and 8B are views for explanation of a second mounting structure in which the antenna device according to the second embodiment is mounted in the LCD side housing.
Figure 8B:
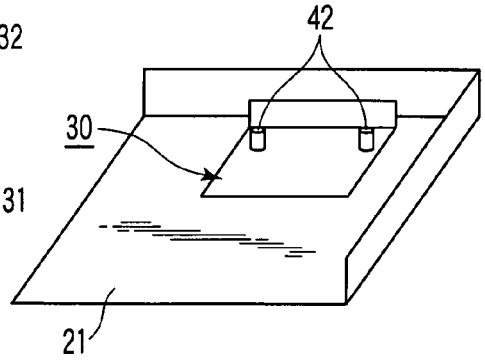

Next, FIGS. 8A and 8B are views for explanation of a second mounting structure in which an antenna device is mounted in an LCD side housing in the second embodiment.

As shown in FIG. 8A, in the same way as in the mounting structure described above, two mounting apertures 37*a* and 37*b* are opened at the holding member 32, and further, as shown in FIG. 8B, convex fixing parts for mounting 42 which are fitted into the mounting apertures 37*a* and 37*b* are formed. By merely fitting the mounting apertures 37*a* and 37*b* of the antenna device to the fixing parts for mounting 42 on the housing, the antenna device can be mounted at position determined in advance, which prevent differences in mounting positions in accordance with an operation, and it is possible to suppress variations in the antenna characteristics. In this mounting structure as well, the same application and effect as those in the first mounting structure can be obtained.

In accordance with the present embodiment, it is possible to provide an antenna device which is to be loaded into a small space in a personal computer, and which maintains antenna characteristics based on a design, and which is made to be a flat design with a simple configuration.

What is claimed is:

1. An antenna device to be implemented on a housing of an information processing apparatus, comprising:

an antenna unit including a first antenna member with a flexural portion, and a second antenna member; and a holding member to hold the antenna unit so as to form a gap between the first antenna member and the second antenna member to be mounted in the housing, the holding member including (i) a window area to expose a region at which the gap is formed and (ii) power feeding regions to which a communication cable for propagating signals received and transmitted is connected.

2. The antenna device according to claim 1, wherein the holding member is positioned further away from the housing than both the first antenna member and the second antenna member and holds the first antenna member and the second antenna member so as to cover the flexural portion of the first antenna member.

3. The antenna device according to claim 2, further comprising a plurality of fixing parts formed at the holding member, the fixing parts being fitted into a plurality of apertures formed in the first antenna member and the second antenna member to hold the antenna unit in a predetermined position.

4. The antenna device according to claim 2, wherein the holding member is fixed to a position of the housing at which a frame body of the display unit and a region arranged to leaving the gap do not overlap with each other when the display unit of the computer is installed.

5. The antenna device according to claim 4, comprising at least two or more fixing parts provided at arbitrary positions on an inner face of the housing of the computer in order for fixing the holding member at the position of the housing.

6. The antenna device according to claim 5, wherein the fixing parts are fitted into apertures provided at regions except for regions to which the antenna members are in contact with the holding member and the window area.

7. The antenna device according to claim 2, wherein the holding member includes a notched portion formed from the window area with the communication cable wired on the notched portion.

8. The antenna device according to claim 2, wherein the holding member includes a guide member which is formed so as to elongate from the window area in parallel with the arranging direction of the two antenna members, and the communication cable are wired along the guide member.

9. The antenna device according to claim 1, wherein the holding member further comprises a reinforcing part to reinforce the holding of the flexural portion of the first antenna member, the reinforcing part being formed so as not to overlap with a display unit at the time of mounting in the housing of the computer.

10. The antenna device according to claim 9, wherein the holding member is provided with an aperture penetrating through the reinforcing part, and the communication cable is wired so as to pass through the aperture.

11. The antenna device according to claim 1, wherein the holding member includes a guide member which is formed so as to cover the flexural portion of the first antenna member from the outside, and to elongate from the window area in parallel with the arranging direction of the two antenna members, and which is formed so as not to overlap with the first antenna member and the second antenna member, and the communication cable are wired along the guide member.

12. An antenna device implemented on a side housing for liquid crystal display panel of a computer, comprising:

an antenna unit including a first antenna member and a second antenna member, a notched side of the first antenna member being separated from second antenna member by a substantially constant gap; and a holding member to secure the first antenna member and the second antenna member and to maintain the gap between the first and second antenna members, the holding member including a window area to expose a region at which the gap is formed.

13. The antenna device according to claim 12, wherein the holding member further includes power feeding regions to which a communication cable for propagating signals received and transmitted by the antenna device is connected.

14. The antenna device according to claim 12, wherein the holding member is positioned with the first and second antenna members between the holding member and an interior of the housing.

15. The antenna device according to claim 14, wherein the holding member further comprises a reinforcing part to reinforce holding of a flexural portion of the first antenna member, the reinforcing part being formed so as not to be overlapped by the liquid crystal display panel at the time of mounting in the housing of the computer.

16. The antenna device according to claim 15, wherein the holding member is provided with an aperture penetrating through the reinforcing part where the communication cable is wired so as to pass through the aperture.

17. The antenna device according to claim 14, wherein the holding member includes a guide member that does not overlap both the first antenna member and the second antenna member and the communication cable being wired along the guide member.

* * * * *